US007700255B2

(12) United States Patent
Kurachi et al.

(10) Patent No.: US 7,700,255 B2
(45) Date of Patent: Apr. 20, 2010

(54) INTERMEDIATE TRANSFER MATERIAL, IMAGE FORMING METHOD AND IMAGE FORMING APPARATUS

(75) Inventors: Masahiko Kurachi, Tokyo (JP); Fumitaka Mochizuki, Tokyo (JP); Naoko Uemura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 484 days.

(21) Appl. No.: 11/677,671

(22) Filed: Feb. 22, 2007

(65) Prior Publication Data

US 2007/0253752 A1 Nov. 1, 2007

(30) Foreign Application Priority Data

Apr. 28, 2006 (JP) ..... 2006-125251

(51) Int. Cl.
*G03G 13/16* (2006.01)

(52) U.S. Cl. ..... 430/125.32; 399/302

(58) Field of Classification Search ..... 430/125.32; 399/302

See application file for complete search history.

(56) References Cited

U.S. PATENT DOCUMENTS 3,893,761 A * 7/1975 Buchan et al. ..... 399/308
5,715,510 A * 2/1998 Kusaba et al. ..... 399/308
5,873,018 A * 2/1999 Aoto et al. ..... 399/302

* cited by examiner

*Primary Examiner*—Mark A Chapman
(74) *Attorney, Agent, or Firm*—Lucas & Mercanti, LLP

(57) ABSTRACT

An intermediate transfer material, for use in an image forming apparatus in which a toner image on an electrostatic latent image carrier is transferred onto the intermediate transfer material and the toner image on the intermediate transfer material is further transferred onto a final transfer material, wherein the intermediate transfer material comprises a substrate layer having thereon a surface layer, and the surface layer comprising a cured (meth)acrylic resin. There are also disclosed an image forming method by use of the intermediate transfer material and an image forming apparatus by use of the image forming method.

23 Claims, 2 Drawing Sheets

INTERMEDIATE TRANSFER MATERIAL, IMAGE FORMING METHOD AND IMAGE FORMING APPARATUS

FIELD OF THE INVENTION

The present invention relates to an intermediate transfer material.

BACKGROUND OF THE INVENTION

Recently, there have been brought into practical use image forming apparatuses of an electrophotographic system which enable copying or printing full-color images. A secondary transfer system using an intermediate transfer material is advantageous as a transfer system of full-color images onto transfer material, in terms of paper-free copying and full copying feasibility and is broadly used.

The secondary transfer system using an intermediate transfer material is a system in which the respective color images of yellow (Y), magenta (M), cyan (C) and black (Bk) which are successively formed on an electrostatic latent image carrier are transferred onto an intermediate transfer material and superposed after which a transferred full-color toner image is transferred in one transfer operation onto a final transfer material, and is also called a intermediate transfer system.

Thermoplastic resins such as polyimide resin or polyamide resin, used in intermediate transfer materials have not been capable to achieve sufficient secondary transferability, specifically in an atmosphere of high temperature and high humidity. To overcome the foregoing problem, there was attempted a process by using an intermediate transfer material of a multilayer structure. Specifically, there was studied reduction of the surface energy of a surface layer. However, enhancement of the secondary transfer rate resulted in lowering of abrasion resistance and sufficient improvement was not achieved, as described in JP-A Nos. 2003-330216, 2004-21188, 2004-4504 and 2005-99182 (hereinafter, the term JP-A refers to Japanese Patent Application Publication).

SUMMARY OF THE INVENTION

The present invention has been achieved to solve the foregoing problems. Thus, it is an object of the invention is to provide an intermediate transfer material exhibiting superior secondary transferability and enhanced abrasion resistance, and an image forming method and an image forming apparatus by use thereof.

The inventors discovered that it was effective to harden the surface of an intermediate transfer material to achieve sufficient secondary transferability and enhanced abrasion resistance. Specifically with respect to secondary transferability, it is assumed that highly hardening the surface layer of an intermediate transfer material results in reduced deformation against compression so that application of transfer pressure in the course of transferring a toner image from the intermediate transfer material onto the secondary transfer material causes little deformation, whereby superior secondary transferability is achieved. As a result of extensive study of hardening of various resins exhibiting high surface hardness such as an epoxy resin, a silicone resin, a hardened acrylic resin and the hardened methacrylic resin, a hardened acrylic type resin was proved to be superior in secondary transferability. The hardened acrylic type resin refers to a hardened acrylic resin or a hardened methacrylic resin.

Since a hardened surface layer, which is sometimes insufficient in slip property and cleaning ability, often cracks or peels from the layer during use over a long duration, a flexible surface layer is preferred to provide enhanced slip property and cleaning ability. It was further discovered that an acrylic resin of a structure having a long chain alkyl group was preferred.

One aspect of the invention is directed to an intermediate transfer material, for use in an image forming apparatus in which a toner image on an electrostatic latent image carrier is primarily transferred onto the intermediate transfer material and the toner image is secondarily transferred onto a final transfer material, comprising a substrate layer and a surface layer and the main component of the surface layer is a cured methacrylic resin or a cured acrylic resin.

Another aspect of the invention is directed to an image forming method comprising developing an electrostatic latent image on an electrostatic latent image carrier by a tone to form a toner image, transfer the toner image on the carrier onto an intermediate transfer material, and transfer the toner image on the intermediate transfer material onto a final transfer material, wherein the intermediate transfer material comprises a substrate layer having thereon a surface layer, and the surface layer comprising a cured (meth)acrylic resin.

Further, another aspect of the invention is directed to an image forming apparatus, used for the image forming method as described above.

DETAILED DESCRIPTION OF THE INVENTION

Figure 1:
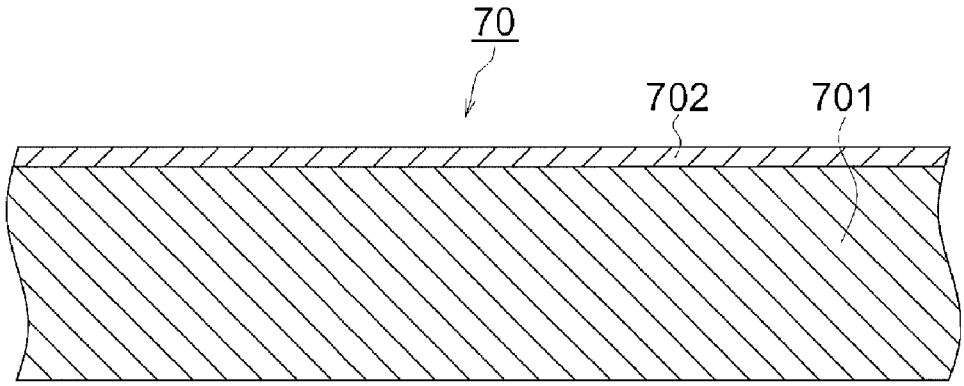
FIG. 1 is a sectional view illustrating an example of the layer arrangement of the intermediate transfer material.

The main component of the surface layer means a component which forms a surface layer coat on the substrate layer of an intermediate transfer material and plays a major role to maintain an appropriate surface hardness of the intermediate element, whereby transferability of a toner is enhanced. Accordingly, the content thereof is not specifically limited so long as it functions sufficiently, but the main component accounts for at least 50% by mass of the total components forming the surface layer.

The chemical structure of hardened methacrylic resin or hardened acrylic resin will be described later but the use of such a resin, which exhibits superior compatibility with various constituent substances constituting the surface layer and is also superior in homogeneous dispersibility of the constituent substances in the hardened layer, resulting in superior transferability and enhanced layer strength.

The substrate layer preferably comprises a resin capable of dissolving or swelling in a coating solvent of the surface layer and a resistance-controlling agent.

Dissolving or swelling in a coating solvent of the surface layer as described above is based on the following criterion. "Dissolving" means that when 1 g of a resin is added to 1 L (liter) of a solvent with stirring, the solution is filtered with a 200 μm mesh filter cloth and the filtrate is evaporated to dryness, at least 0.01 g of the resin exist. "Swelling" is defined by the following evaluation. A 100 mm×10 mm strip resin sample with a thickness of 100±50 μm is allowed to settle in 500 ml of the objective solvent, while maintained at a temperature of 22±1° C. After being stirred for 1 min., the resin sample is pulled up and after the solvent on the surface and the back is wiped off, the resin sample is placed onto a plate and covered with a 2 mm thick glass plate to measure the longitudinal length of the sample. The case of being stretched more than the length before being dipped into the solvent by 0.5% is judged as having been swelled.

In the case of a multilayer structure, when the resin used in the substrate layer is a hetero-compound, interaction with the surface layer increases, resulting in enhanced compatibility. It is assumed to act as an intermolecular force due to an unshared electron pair of an atom other than carbon atoms of the resin.

To achieve higher durability over a longer period of time, there are concerns that excessive hardening of the surface of an intermediate transfer material causes cracking at the last stage of the use over the long period. In light thereof, the use of a bi-functional acrylic monomer or a monomer containing a long chain alkyl group, or incorporation of an acrylate oligomer is preferred, whereby the free volume is increased, leading to increased flexibility. An intermediate transfer material of such a structure, in which the uppermost surface of the surface layer is hard and the whole surface layers are softened to some extent, is superior not only in abrasion resistance and secondary transferability but also in durability.

The foregoing hetero-compound refers to a compound containing atoms other than carbon and hydrogen atoms (i.e., heteroatoms), such as nitrogen, oxygen and sulfur. Specifically, the chemical structure thereof is one including an ester linkage, urethane linkage, imide linkage, amide linkage, ether linkage or sulfide linkage. Specific example of such a resin of a hetero-compound include a poly(phenylene sulfide), polyimide, poly(amidoimide), polycarbonate, poly(ethylene terephthalate), poly(butylene terephthalate), polyester, poly (butylene succinate), polyether and polyetherketone. Of these, a poly(phenylene sulfide), polyimide, poly(amidoimide) and polycarbonate are preferred, and poly(phenylene sulfide) or polyimide is more preferred.

Next, there will be further described compounds and image forming methods/apparatuses used in the invention.

Layer Arrangement

The layer arrangement of the intermediate transfer material of the invention preferably is a substrate layer having thereon a surface layer. An interlayer may optionally be provided between the substrate layer and the surface layer to enhance adhesion of the substrate layer to the surface layer. FIG. 1 is a sectional view illustrating an example of the layer arrangement of the intermediate transfer material. In FIG. 1, the numeral 70 designates an intermediate transfer material, the numeral 701 designates a substrate layer and the numeral 702 designates a surface layer.

The intermediate transfer material of the invention preferably is an intermediate transfer belt comprising a surface layer provided on a belt-form resin substrate.

The method for manufacturing the intermediate transfer material of the invention is preferably one comprising a step of exposure to at least one of a heat ray, an actinic ray and an electron beam to harden the surface layer.

The thickness of a intermediate transfer material, depending on the objective use, is preferably from 5 to 500 μm to satisfy mechanical characteristics such as strength or flexibility, more preferably from 10 to 300 μm, and still more preferably from 20 to 200 μm.

In the invention, "surface" refers to a face onto which a toner image carried by an electrostatic latent image carrier is transferred.

Next, the intermediate transfer material of the invention will be further described with respect to the substrate layer, composition of the surface layer and the manufacturing method of the intermediate transfer material.

First, the individual layers constituting the intermediate transfer material will be described below.

Substrate Layer

The substrate layer relating to the invention is not specifically limited but can be prepared by using commonly known materials according to formation methods known in the art.

Commonly known materials may be metals and preferred examples thereof include a polycarbonate, poly(phenylene sulfide), poly(vinylidene fluoride), polyimide, poly(amidoimide), polyether, polyetherketone and their mixtures or copolymers.

Formation methods include, for example, coating a solution of a resin dissolved in solvent and direct film formation, of which the direct film formation method is preferred.

Methods for forming the substrate layer by direct film formation of a resin include, for example, extrusion molding and inflation molding. In either of these methods, resin material and electric conductive substances are fused and kneaded, and in the case of extrusion, the resin is extruded and cooling-molded, while in the case of inflation, fused resin is made in a tubular form, into which air is blown, and is molded to an endless belt form.

There will be described preparation of a substrate layer composed mainly of poly(phenylene sulfide) by extrusion molding. The substrate layer composed mainly of poly(phenylene sulfide) is formed of poly(phenylene sulfide), a graft copolymer of an epoxy group-containing olefin copolymer and a vinyl (co)polymer, a conductive filler and a lubricant.

Poly(phenylene sulfide), which is also denoted simply as PPS, usable in the invention is a thermoplastic resin having an alternately arranged structure of a phenylene unit and a sulfur atom. The phenylene unit, which may be substituted, is an o-phenylene unit, a m-phenylene unit or a p-phenylene unit, which may be mixed in various combinations. Preferred phenylene units include at least a p-phenylene unit at a content of not less than 50% of the total phenylene units. The phenylene unit is preferably comprised of an unsubstituted phenylene unit.

Conductive fillers usable in the invention include carbon black. Specifically, neutral carbon black is usable. The amount of a conductive filler to be incorporated depends on its kind but it is incorporated so as to allow the volume resistance and surface resistance of an intermediate transfer material to fall within a prescribed range, preferably in an amount of 10 to 20 parts by mass of 100 parts by mass of poly(phenylene sulfide), and more preferably 10 to 16 parts by mass.

In the invention, lubricants are used to improve molding to an intermediate transfer material and examples of such a lubricant include aliphatic hydrocarbons such as paraffin wax and polyolefin wax; higher fatty acids such as lauric acid, myristic acid, palmitic acid, stearic acid and behenic acid; and higher fatty acid metal salts such as sodium, lithium or calcium salts of the foregoing higher fatty acids. A lubricant may be used alone or in combinations thereof. A lubricant is incorporated preferably in an amount of 0.1 to 0.5 parts by mass of 100 parts by mass of poly(phenylene sulfide), and more preferably 0.1 to 0.3 parts by mass.

The substrate layer is formed in such a manner that a mixture of the materials described above is charged into an axis extruder provided with a circular die and a fused resin composition is extruded from a seamless belt-form, resin-discharge opening at the top of the circular die and then inserted outside a cooling cylinder to solidify the resin, whereby molding into a seamless cylindrical form is readily achieved.

In order to inhibit crystallization, it is preferred to cool with water, air or a cooled metal block immediately after the belt is ejected from the die. Specifically, a cooling cylinder provided in a die and sandwiched with a heat insulating material is used, whereby heat of the belt is rapidly removed. Water controlled at a temperature of 30° C. or less is constantly circulated inside the cooling cylinder. The belt ejected from the die is pulled out at a relatively high speed, whereby thin layer formation and enhanced cooling is achieved. The pulling speed is preferably not less than 1 m/min, and more preferably from 2 to 7 m/min.

In the case when the ratio of the diameter of a cylindrical die (D) to that of a cooling cylinder (d), D/d is in the range of 0.9 to 1.1, pulling-out is performed by a pulling device, while inserting resin extruded from the circular die to the outside of the cooling cylinder. In the case of D/d of 0.9 to 0.98, vacuum pulling is needed between the circular die and the cooling cylinder to insert the resin along the cooling cylinder. In the case of D/d of 0.99 to 1.02, however, the resin can be inserted along the cooling cylinder without vacuum pulling between the circular die and the cooling cylinder, whereby no pulsation due to vacuum pulling results, leading to advantages of lessened variation in layer thickness in the pulling-out direction.

Further, polyimide resin is also usable as a resin used for the substrate layer. Formation of the substrate layer by using a polyimide resin is performed by the methods described in JP-A No. 2004-123774 and 2005-14440.

Surface Layer

Cured methacrylic resin or cured acrylic resin is used as a main component of the resin forming the surface layer.

A surface layer formed of a cured (meth)acrylic resin can be obtained by forming a layer containing a polymerizable acrylic or methacrylic monomer, i.e., a (meth)acrylic monomer or its oligomer together with a polymerization initiator and exposing the formed layer, for example, to ultraviolet rays. Such an acrylic or methacrylic monomer or its oligomer is preferably a compound containing plural acryloyl groups ($CH_2{=}CHCO{-}$) or methacryloyl groups ($CH_2{=}C(CH_3)CO{-}$).

The foregoing monomer or oligomer preferably contains, in the molecule, a lubricant constituent such as an alkyl chain, a silicone chain or a urethane chain to achieve both hardness and flexibility. Further, to provide peeling capability or cleaning capability, the monomer or oligomer preferably contains a long alkyl chain and more preferably an alkyl group having 12 or more carbon atoms) in the molecule. It is assumed that this site plays a role to provide enhanced peeling ability and slipperiness, leading to enhanced image stability even in practice over the long period of time. The number of carbon atoms of an alkyl group refers to the number of bonding carbon atoms, interrupted by non-carbon atom(s).

When curing of the surface layer is performed by exposure to light, it is preferred to use adjusting agents, not absorbing the light. Such adjusting agents include silicone oil, a dispersing aid and an antioxidant.

Specific examples of (meth)acryloyl monomers are shown below.

| Compound No. | Structural Formula | No. of (Meth)acryloyl Groups |
|---|---|---|
| (1) | 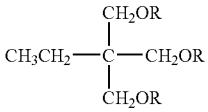 | 3 |
| (2) | 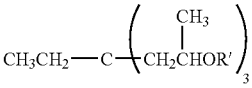 | 3 |
| (3) | 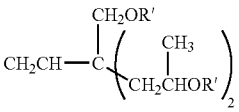 | 3 |
| (4) | 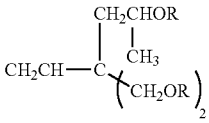 | 3 |
| (5) | 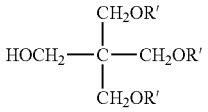 | 3 |
| (6) | 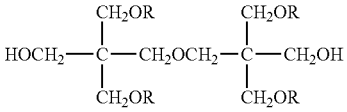 | 4 |

-continued
| Compound No. | Structural Formula | No. of (Meth)acryloyl Groups |
|---|---|---|
| (7) | $ROCH_2-C(CH_2OR)_2-CH_2OCH_2-C(CH_2OR)_2-CH_2OR$ | 6 |
| (8) | $(R'OCH_2)_3C-CH_2OCH_2-C(R'OC_5H_{10}-C(=O)=O)_2-CH_2OR'$ | 6 |
| (9) | 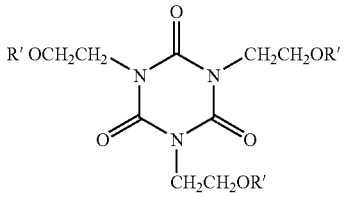 | 3 |
| (10) | $CH_3CH_2C-(CH_2OC_3H_6OR)_3$ | 3 |
| (11) | 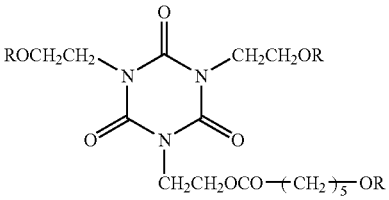 | 3 |
| (12) | $(ROCH_2)_3C-O-C-(CH_2OR)_3$ | 6 |
| (13) | $(ROCH_2)_3C-CH_2OCH_2-C(H)-(CH_2OR)_2$ | 5 |
| (14) | $(ROCH_2)_3C-CH_2OCH_2-C(CH_3)-(CH_2OR)_2$ | 5 |
| (15) | $(ROCH_2)_3C-CH_2OCH_2-C(CH_2OH)-(CH_2OR)_2$ | 5 |
| (16) | $(R'OCH_2)_3C-CH_2OCH_2-C(CH_2OR')-(CH_2OH)_2$ | 4 |
| (17) | $(ROCH_2)_3C-O-C(CH_2OH)-(CH_2OR)_2$ | 5 |
| (18) | 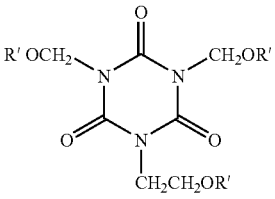 | 3 |
| (19) | $CH_3CH_2C-C-(CH_2CH_2OR)_3$ | 3 |

-continued
| Compound No. | Structural Formula | No. of (Meth)acryloyl Groups |
|---|---|---|
| (20) | $HOCH_2-C\left(CH_2O-\underset{\underset{O}{\parallel}}{C}CH_2CH_2CH_2CH_2CH_2OR\right)_3$ | 3 |
| (21) | 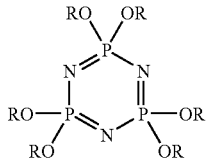 | 6 |
| (22) | 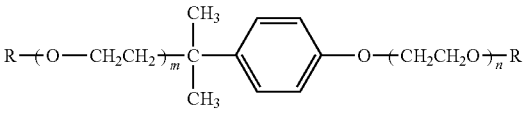 | 2 |
| (23) | 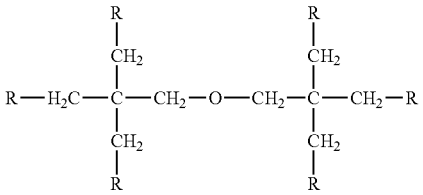 | 6 |
| (24) | 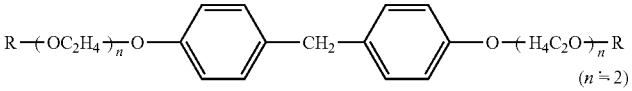 ($n \fallingdotseq 2$) | 2 |
| (25) | 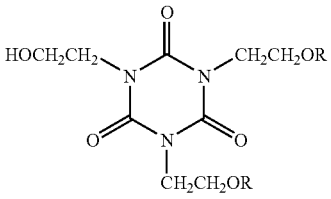 | 2 |
| (26) | $R-(OC_3H_6)_3-OR$ | 2 |
| (27) | 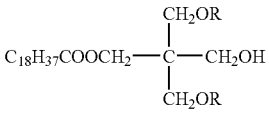 | 2 |
| (28) | 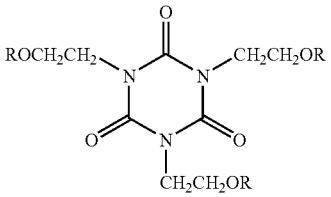 | 3 |
| (29) | $\left[R-(OC_3H_6)_n-OCH_2\right]_3CCH_2CH_3$ ($n \fallingdotseq 3$) | 3 |
| (30) | 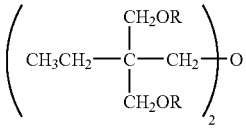 | 4 |

-continued

| Compound No. | Structural Formula | No. of (Meth)acryloyl Groups |
|---|---|---|
| (31) | $(ROCH_2)_4C$ | 4 |
| (32) | $RO—C_6H_{12}—OR$ | 2 |
| (33) | $RO\left(CH_2\overset{\overset{\displaystyle CH_2}{\vert}}{C}HO\right)_3R$ | 2 |
| (34) | $RO(C_2H_4O)_2$ 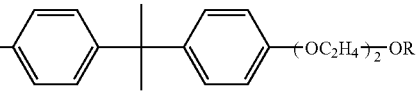 $(OC_2H_4)_2OR$ | 2 |
| (35) | $ROCH_2$ 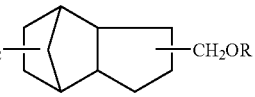 $CH_2OR$ | 2 |
| (36) | $RO(C_2H_4O)_9R$ | 2 |
| (37) | $CH_3CH_2—C(CH_2(OC_2H_4)_lOR)(CH_2(OC_2H_4)_mOR)(CH_2(OC_2H_4)_nOR)$ $(l+m+n=3)$ | 3 |
| (38) | $CH_3CH_2—C(CH_2(OCOC_5H_{12})_lOR)(CH_2(OCOC_5H_{12})_mOR)(CH_2(OCOC_5H_{12})_nOR)$ $(l+m+n=3)$ | 3 |

$R = —\overset{\overset{\displaystyle O}{\Vert}}{C}—\overset{\overset{\displaystyle H}{\vert}}{C}=CH_2,$ $R' = —\overset{\overset{\displaystyle O}{\Vert}}{C}—\overset{\overset{\displaystyle CH_3}{\vert}}{C}=CH_2$ Specific examples of polymerization initiators used for ultraviolet curing resins include benzophenone, Michier's (ketone N,N'-tetramethyl-4,4'-diaminobenzophenone), 1-hydroxycyclohexyl phenyl ketone, thioxanthone, benzobutyl ether, acyloxime, dibenzothrone, and bisacylphosphine oxide.

The surface layer may optionally contain additives, e.g., resistance controlling agents such as a conductive substance or an inorganic filler.

Characteristics of the surface layer are affected by the kind of a ultraviolet curing (meth)acrylic monomer or oligomer and its composition, ultraviolet exposure conditions, and the like. A cured (meth)acrylic resin forming the surface layer of an intermediate transfer material is preferably one which is formed by reacting a monomer containing at least two functional groups, one which is formed by reacting a monomer containing at least five functional groups, one which is formed by reacting (meth)acrylic monomer containing an alkyl group having 12 or more carbon atoms, or one which is formed by reacting an oligomer containing two functional groups (or bi-functional oligomer), whereby superior characteristics can be achieved.

The reason therefor is that increasing surface hardness is preferable for enhancement of transferability and increasing the number of functional groups is preferred for enhancement of surface hardness. Two or more functional groups form a cured layer, resulting in enhanced surface hardness. More preferred embodiment to achieve high transferability is the use of a raw material having at least five functional groups. Enhancing hardness also results in increased possibility of the formed layer becoming more fragile and more easily cracking, so that a structure having a long molecular chain is preferred. In the case of hydrocarbons, a surface layer exhibiting a hardness of a minute area which enables to enhance transferability and macroscopic flexibility resistant to cracking can be obtained by curing a compound having an alkyl chain of 12 or more carbon atoms.

To achieve such advantageous characteristics as described above, (meth)acrylic monomers or oligomers are used in combination thereof. For instance, the combination of a monomer containing at least two (meth)acryloyl groups and another monomer is preferred, and the combination of a monomer containing at least three (meth)acryloyl groups and another monomer is more preferred. Specifically, a monomer containing at least two (meth)acryloyl groups preferably accounts for 40 to 90% by mass, and more preferably 50 to 80% by mass of total monomers, whereby suitable hardness and flexibility are achieved, leading to enhanced secondary transfer capability and cracking resistance.

A surface layer is provided on the substrate layer preferably in such a manner that a coating solution of the surface layer is coated onto the substrate layer by spray coating to form a coat and primarily dried to such an extent that the coat exhibits no fluidity, thereafter, the coat is exposed to ultraviolet rays to harden a ultraviolet curing resin and further subjected to secondary drying to control the amounts of volatile substances contained in the coat.

A spray coating solution can be prepared by mixing a ultraviolet curing acrylic monomer or oligomer, a polymerization initiator and a diluting solvent and optionally a conductive substance, an inorganic filler and resistance controlling agent, followed by dispersion of the mixture by using a sand mill or a stirring device.

Any solvent capable of dissolving an ultraviolet curing acrylic monomer or oligomer and a polymerization initiator is usable as a diluting or coating solvent. Specific examples of such a solvent include n-butyl alcohol, isopropyl alcohol, ethyl alcohol, methyl alcohol, methyl isobutyl ketone, and methyl ethyl ketone. In the invention, the substrate layer is preferably comprised of a resin capable of dissolving or swelling in a coating solvent of the surface layer, leading to enhanced adhesion between the substrate layer and the surface layer.

Commonly known devices used for hardening ultraviolet curing resins are usable as an ultraviolet exposure device.

The dose ($mJ/cm^2$) of ultraviolet rays necessary to cure a resin is preferably controlled by ultraviolet exposure intensity and exposure time.

Incorporation of resistance controlling agents to the substrate layer or the surface layer is preferred, as described above. Such resistance controlling agents include electrically conductive material particles and various kinds of fillers.

Examples of conductive material include metals, metal oxides, conductive polymers and carbon black. Specific examples of such metals include aluminum, zinc, copper, chromium, nickel, stainless steel, silver and these metals deposited on a plastic resin. Specific examples of metal oxides include zinc oxide, titanium oxide, tin oxide, antimony oxide, indium oxide, bismuth oxide, antimony-doped tin oxide and zirconium oxide. Specific examples of conductive polymers include polyacetylene, polythiophene and polypyrrole.

A conductive material usable in the invention preferably exhibits a specific surface resistance of $10^{11}$ to $10^{14}$ Ω·cm. An excessively low surface resistance results in insufficient electric field application to a toner, leading to transfer troubles. An excessively high surface resistance often causes dusts of line texts due to transfer repellency.

When the surface layer is cured by exposure to light, a resistance controlling agent exhibiting a relatively low absorption of the light used for exposure is preferred. Specifically, when exposed to ultraviolet rays, a resistance controlling agent such as tin oxide or antimony oxide.

Image Forming Method and Apparatus

Next, there will be described an image forming method and an image forming apparatus relating to the invention.

The image forming apparatus relating to the invention comprises, on an electrostatic latent image carrier (typically, an electrophotographic photoreceptor and hereinafter also denoted simply as a photoreceptor), an electrostatic-charging means, an exposure means, developing means by using a developer, inclusive of micro-particulate toner and a transfer means to transfer a toner image formed by the developing means to the final transfer material through an intermediate transfer material.

Examples thereof include a copier and a laser printer. Specifically, an image forming apparatus capable of undergoing continuous printing of 5,000 sheets or more is preferred. In such an apparatus, a large quantity of printing is done within a relatively short time and troubles relating to transfer tend to easily occur. The use of the intermediate transfer material of the invention which achieves stable secondary transfer leads to preferred results.

An image forming apparatus in which the intermediate transfer material of the invention is usable comprises a photoreceptor to form a latent image corresponding to image data, a developing device to develop the latent image formed on the photoreceptor to form a toner image, a primary transfer means to transfer the toner image on the photoreceptor onto an intermediate transfer material and a secondary transfer means to transfer the toner image on the intermediate transfer material onto a final transfer material such as paper or an OHP sheet. Disposing the intermediate transfer material of the invention can achieve stable image formation without causing transfer troubles in the secondary transfer.

An image forming apparatus in which the intermediate transfer material of the invention is usable is applicable to a monochromatic image forming apparatus which undergoes image formation by a toner of a single color. However, there is the more preferred application to a color image forming apparatus in which toner images on the photoreceptor are successively transferred onto an intermediate transfer material and a tandem color image forming apparatus in which plural photoreceptors corresponding to the respective colors are disposed in series on an intermediate transfer material.

Figure 2:
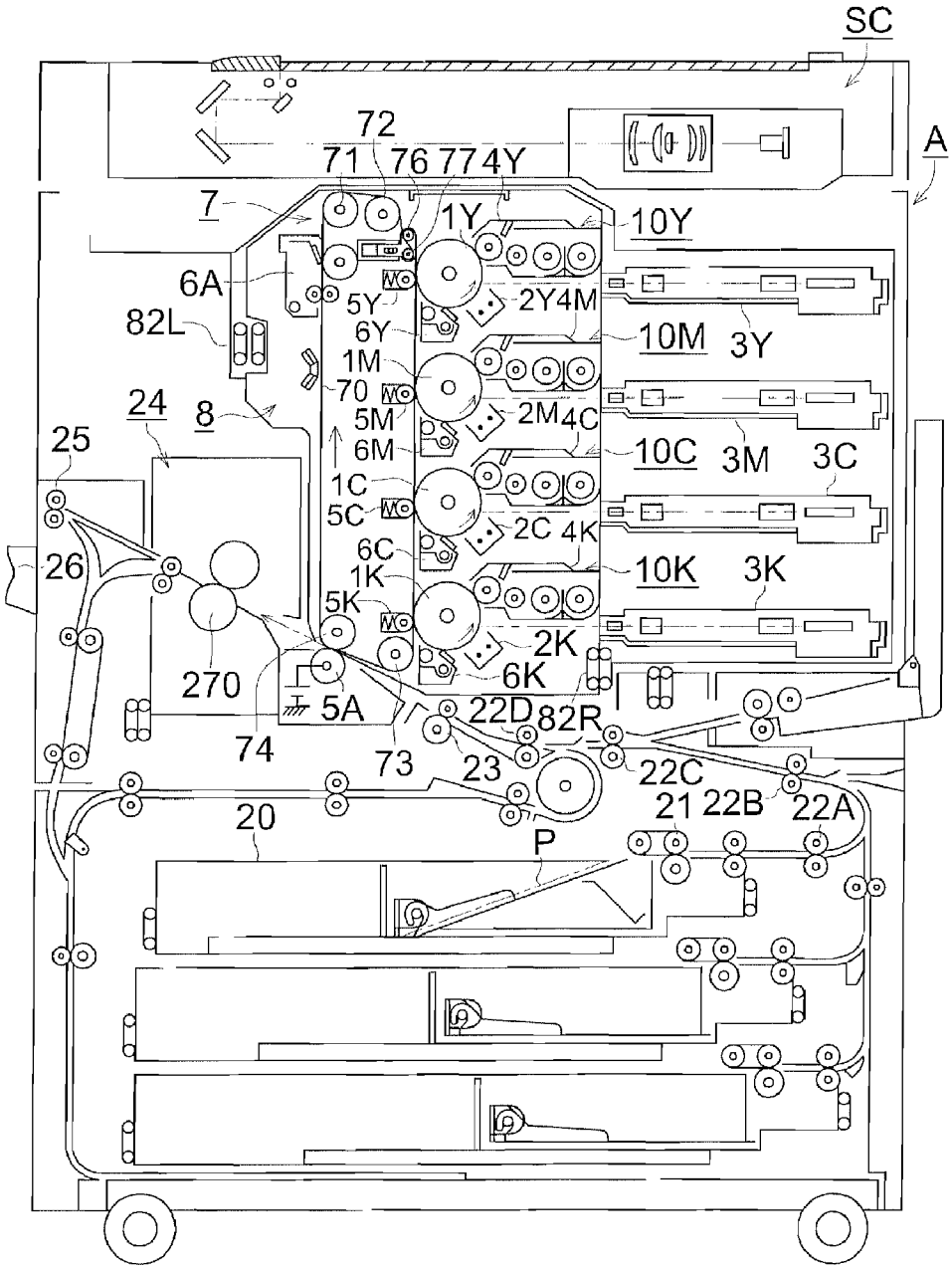
FIG. 2 illustrates a sectional view of an example of an image forming apparatus in which the intermediate transfer material of the invention can be used.

The intermediate transfer material of the invention is effective for use in a tandem color image forming apparatus. FIG. 2 illustrates a sectional view of an example of an image forming apparatus in which the intermediate transfer material of the invention can be used.

In FIG. 2, 1Y, 1M, 1C and 1K each designate photoreceptors; 4Y, 4M, 4C and 4K each designate a developing means; 5Y, 5M, 5C and 5K each designate primary transfer rollers as a primary transfer means; 5A designates a secondary transfer roller as a secondary transfer means; 6Y, 6M, 6C and 6K each designate cleaning means; the numeral 7 designates an intermediate transfer unit; the numeral 24 designates a thermal roll type fixing device; and the numeral 79 designates an intermediate transfer material.

This image forming apparatus is called a tandem color image forming apparatus, which is, as a main constitution, comprised of plural image forming sections 10Y, 10M, 10C and 10B, an intermediate transfer material unit 7 as a transfer section including an endless belt form of a transfer belt, paper feeding and conveying means 22A to 22D to convey recording member P and heated roll-type fixing device 24 as a fixing means. Original image reading device SC is disposed in the upper section of image forming apparatus body A.

Image forming section 10Y to form a yellow image as one of different color toner images formed on the respective photoreceptors comprises drum-form photoreceptor 1Y as the first photoreceptor; electrostatic-charging means 2Y, exposure means 3Y and developing means 4Y which are disposed around the photoreceptor 1Y; primary transfer roller 5Y as a primary transfer means; and cleaning means 6Y.

Image forming section 10M to form a magenta image as one of different color toner images formed on the respective photoreceptors comprises drum-form photoreceptor 1M as the second photoreceptor; electrostatic-charging means 2M, exposure means 3M and developing means 4M which are disposed around the photoreceptor 1M; primary transfer roller 5M as a primary transfer means; and cleaning means 6M.

Image forming section 10C to form a cyan image as one of different color toner images formed on the respective photoreceptors comprises drum-form photoreceptor 1C as the third photoreceptor; electrostatic-charging means 2Y, exposure means 3C and developing means 4C which are disposed around the photoreceptor 1C; primary transfer roller 5C as a primary transfer means; and cleaning means 6C.

Image forming section 10K to form a black image as one of different color toner images formed on the respective photoreceptors comprises drum-form photoreceptor 1K as the fourth photoreceptor; electrostatic-charging means 2K, exposure means 3K and developing means 4K which are disposed around the photoreceptor 1K; primary transfer roller 5K as a primary transfer means; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray outside a machine.

After a color image is transferred onto recording member P by secondary transfer roller 5A, intermediate transfer material 70 which separated recording member P removes any residual toner by cleaning means 6A.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Image forming sections are arranged vertically in a line. Intermediate transfer material unit 7 of an endless belt form is disposed on the left side of photoreceptors 1Y, 1M, 1C and 1K, as indicated in FIG. 2. Intermediate transfer material unit 7 comprises the intermediate transfer unit (7) of an endless belt form which can be turned via rollers 71, 72, 73, 74 and 76, primary transfer rollers 5Y, 5M, 5C and 5K and cleaning means 6A.

In the process of image formation, toner images are formed on photoreceptors 1Y, 1M, 1C and 1K, through electrostatic-charging, exposure and development, toner images of the individual colors are superimposed on the endless belt form, intermediate transfer material (70), transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Recording Member

A recording member used in the invention is a support holding a toner image and conventionally called a image supporting material, a (final) transfer material or transfer paper. Specific examples thereof include plain thin to heavy paper, coated printing paper such as art paper or coat paper, commercially available Japanese paper or post card paper, plastic film used for OHP (overhead projector) and cloth, but are not limited to these.

Developer

Developers are not specifically limited if they are usable in dry development. Since a development system is not specifically limited, developer usable in the invention may be a two-component developer comprised of a carrier and a toner or a single component developer comprised of a toner alone. In the case of a single component developer, a non-magnetic single component developer using a non-magnetic toner containing no magnetic material is preferred, except for a black toner (Bk toner).

There can be used binding resins for a toner, known in the art, such as a styrene-acrylic resin and a polyester resin. Manufacturing methods of a toner may be a pulverization process or a polymerization process.

The volume median diameter (D50) of toner particles is preferably from 2.5 to 7.0 μm.

EXAMPLES

Preferred embodiments of the invention and performance thereof are described below with reference to examples but the present invention is not limited to these. In the following examples, "part(s)" means part(s) by mass, unless otherwise noted.

Intermediate Transfer Material

Intermediate Transfer Material 1

(1) Preparation of Substrate Layer

Substrate Layer 1

To an N-methyl-2-pyrrolidone solution (18% solids) of polyamide acid (NMP, U-varnish, produced by Ube Kosan Co., Ltd.), formed of 3,3'4,4'-biphenyltetracarboxylic acid dianhydride (BPDA) and p-phenylenediamine (PDA) was added an electric conductive agent in an amount of 23 parts by mass per 100 parts by mass of polyimide resin solids and mixed using a collision type dispersing machine (Geanus PY, produced by Geanus Co.) by passing five times such a path that the mixture was divided into halves at a minimum area of 1.4 $mm^2$ under a pressure of 200 MPa to collide and then, the mixture was again divided. A polyamide acid solution containing a conductive agent, used for the substrate layer was thus obtained.

The thus obtained polyamide acid solution was coated via a dispenser on the inner surface of a cylindrical metal mold at a coating thickness of 0.5 mm and rotated at 1500 rpm for 15 min. to form a uniform development layer. Further thereto, 60° C. hot air was blown from the outside, while rotating at 250 rpm and then heated at 150° C. for 60 min. Thereafter, the temperature was raised to 360° C. at a rate of 2° C./min and heating at 360° C. continued for 30 min. to remove all solvents and water produced in ring colure dehydration and completion of imide conversion reaction. Then, the temperature was lowered to room temperature, separation from the metal mold was made to obtain the targeted substrate layer 1 in an endless belt form. The total thickness of the substrate layer 1 was 100 μm.

Substrate Layer 2

| | |
|---|---|
| Polyphenylene sulfide (PPS) resin E2180 (produced by Toray) | 100 parts |
| Conductive filler Furnace #3030B (produced by Mitsubishi Kagaku) | 16 parts |
| Graft copolymer Modiper A4400 (produced by Nippon Yushi Co., Ltd.) | 1 part |
| Lubricant (calcium montanate) | 0.2 parts |

The foregoing composition was fed into a single-spindle extruder, fused and kneaded to obtain a resin mixture. A circular form die having a slit, seamless belt-formed discharging-opening was mounted at the top of the single-spindle extruder and the kneaded resin mixture was extruded in the form of a seamless belt. The thus extruded resin mixture in a seamless belt form was inserted to the outer surface of a cooling cylinder, cooled and solidified to obtain 150 μm thick substrate layer 2 in the form of a seamless cylinder. The ratio of diameter of the circular form die (D) to that of the cooling cylinder (d), D/d was 1.00.

Substrate Layer 3

Polyurethane was used to prepare the substrate layer. Thus, 100 parts of polyol was heated to 80° C. and 10 parts of conductive carbon (Kechen Black 600JD) was added thereto and dispersed, while a stirring for 1 hr. Further thereto, 60 parts of 80° C. isocyanate was added and dispersed by stirring for 3 min. to obtain a centrifugal dispersion. The dispersion was fed into a molding machine and dispersed with rotation of 2,000 rpm at 120° C. for 3 hrs. to perform heat-curing. Thereafter, after being aged for 15 hrs. at 80° C., ambient cooling to room temperature was allowed. The molded material was taken out of the molding machine and the end portion was removed by cutting to obtain substrate layer 3.

Swellability in a solvent was determined with respect to the substrate layers 1-3. A mixture of MIBK/MEK (=8/2 by mass) was used as solvents (MIBK: methyl isobutyl ketone, MEK: methyl ethyl ketone).

The degree of swelling of the substrate layers is as below:

Substrate layer 1: less than 0.1%

Substrate layer 2: 1.1%

Substrate layer 3: 0.3%

(2) Formation of Surface Layer

Coating Composition

| | |
|---|---|
| Resin raw material KAYARD PET 30 (NIPPON KAYAKU CO. LTD.) | 100 parts |
| Polymerization initiator Irgacure 184 (Ciba Specialty Chemicals) | 1.0 part |
| Conductive substance T-1 (antimony oxide-doped tin oxide, 20% solids, MITSUBISHI MATERIAL CORP.) | 50 parts |
| Inorganic filler, MEK Si Sol (20% solid, Nissan Kagaku Kogyo) | 20 parts |
| Lubricant PTFE dispersion NS-10S (Kitamura Kagaku) | 30 parts |
| Leveling agent, polydimethylsiloxane | 1.0 part |
| Solvent MIBK/MEK (8/2) | 1500 parts |

The foregoing composition was mixed with stirring to prepare a coating solution of the surface layer. A cylindrical belt formed of the substrate layer 1 was hung around a two-axis rotation apparatus and thereon, the coating solution of the surface layer was spray-coated with rotating, subjected to primary drying in an oven at 30° C. for 30 min. and then exposed to an ultraviolet lamp exhibiting a ultraviolet intensity of 1 kW/cm at an integrate exposure of 2000 mJ/cm$^2$ to perform curing to obtain intermediate transfer material 1.

TABLE 1

| Trade Name | Compound | Name of Maker | Functional Group*1 | Molecular Structure | Number of Carbons*2 |
|---|---|---|---|---|---|
| PET30 | — | NK*3 | 4 | 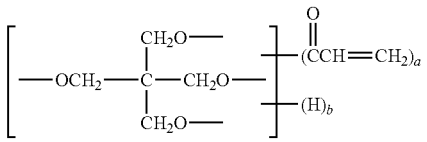 mixture: ($a \approx 3$ $b \approx 1$) + ($a = 4$ $b = 0$) | 5 |
| DPHA | — | NK | 6 | 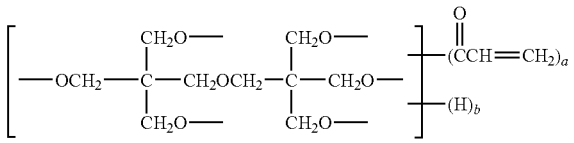 mixture: ($a = 5$ $b = 1$) + ($a = 6$ $b = 0$) | 5 |
| PEG400DA | — | NK | 2 | 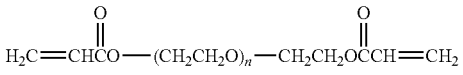 $\overline{n} = 8$ | 2 |
| BLENMER LMA | Lauryl metacrylate | NY*4 | — | | 12 |

TABLE 1-continued

| Trade Name | Compound | Name of Maker | Functional Group*1 | Molecular Structure | Number of Carbons*2 |
|---|---|---|---|---|---|
| MANDA | — | NK | 2 | 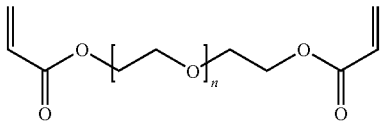 $n = 8$ | 2 |
| D-310 | — | NK*3 | 3 | 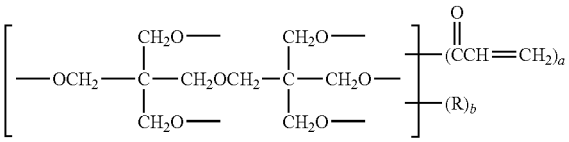 R = Alkynoyl $a = 5$, $b = 1$ | 5 |
| UX8101 | UAO*5 | NK | 2 | 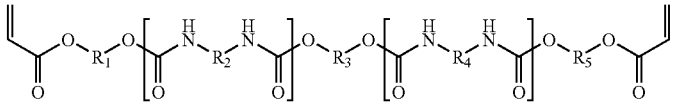 | — |
| KP854 | PMMA*6 | SK*7 | — | Silicone hard-coat agent | 0 |
| BLENMER SA | Stearyl acrylate | NY | 1 | 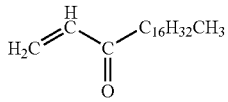 | 17 |
| BLENMER LA | Lauryl acrylate | NY | 1 | 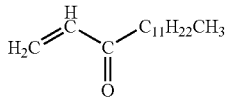 | 17 |

*1Maximum number of functional groups
*2Maximum number of carbon atoms of an alkyl group contained in monomer
*3NIPPON KAYAKU CO., LTD.
*4Nihon Yushi (NOF),
*5Urethane acrylate oligomer
*6Poly(methyl methacrylate),
*7Shin-Etsu Kagaku Kogyo Intermediate Transfer Material 2

Intermediate transfer material 2 was prepared similarly the foregoing intermediate transfer material 1, except that resin raw material (KAYARD PET 30, four-functional acrylic monomer containing four acryloyl groups) was replaced by 70 parts of KAYARD DPHA (six-functional acrylic monomer containing 6 acryloyl groups, produced by NIPPON KAYAKU) and 30 parts of KAYARAD PEG 400DA (two-functional acrylic monomer containing two acryloyl groups, produced by NIPPON KAYAKU).

Intermediate Transfer Material 3

Intermediate transfer material 3 was prepared similarly the foregoing intermediate transfer material 1, except that resin raw material (KAYARD PET 30) was replaced by 70 parts of KAYARD DPHA (produced by NIPPON KAYAKU) and 30 parts of BLENMER LA (monofunctional acrylic monomer containing one acryloyl group, lauryl acrylate, produced by Nihon Yushi).

Intermediate Transfer Material 4

Intermediate transfer material 4 was prepared similarly the foregoing intermediate transfer material 1, except that resin raw material (KAYARD PET 30) was replaced by 70 parts of KAYARD DPHA (produced by NIPPON KAYAKU) and 30 parts of KAYARAD MANDA (acrylic monomer containing two acryloyl groups, produced by NIPPON KAYAKU).

Intermediate Transfer Material 5

Intermediate transfer material 5 was prepared similarly the foregoing intermediate transfer material 1, except that resin raw material (KAYARD PET 30) was replaced by KAYARD D-310 (acrylic monomer containing 5 acryloyl groups, produced by NIPPON KAYAKU).

Intermediate Transfer Material 6

Intermediate transfer material 6 was prepared similarly the foregoing intermediate transfer material 1, except that resin raw material (KAYARD PET 30) was replaced by 70 parts of KAYARD DPHA (produced by NIPPON KAYAKU) and 30 parts of UX 8101 (urethane acrylate oligomer containing two acryloyl groups, produced by NIPPON KAYAKU).

Intermediate Transfer Material 7

Intermediate transfer material 7 was prepared similarly the foregoing intermediate transfer material 1, except that the substrate layer was replaced by a nickel seamless film.

Intermediate Transfer Material 8

Intermediate transfer material 8 was prepared similarly the foregoing intermediate transfer material 1, except that the surface layer was not provided.

Intermediate Transfer Material 9

Intermediate transfer material 9 was prepared similarly the foregoing intermediate transfer material 1, except that resin raw material (KAYARD PET 30) was replaced by 100 parts of silicone KP 854 (Produced by Shin-Etsu Kagaku Kogyo) and curing was done in oven at 90° C. for 120 min.

Intermediate Transfer Material 10

Intermediate transfer material 10 was prepared similarly the foregoing intermediate transfer material 1, except that 60 parts of resin raw material (KAYARD PET 30) was replaced by 60 parts of poly(methyl methacrylate) (PMMA, viscosity-average molecular weight: 30,000) and drying was conducted in an oven at 70° C. for 60 min.

Intermediate Transfer Materials 11-14

Intermediate transfer materials 11-14 (PPS substrate layer) were prepared similarly to the intermediate transfer materials 1-4, respectively, except that the substrate layer 1 was replaced by the substrate layer 2.

Intermediate Transfer Material 15

Intermediate transfer material 15 was prepared similarly to the intermediate transfer material 5, except that the substrate layer 1 was replaced by the substrate layer 2 and D-310 of the intermediate transfer material 5 was replaced by PEG 400DA.

Intermediate Transfer Materials 16 and 17

Intermediate transfer materials 16 and 17 (intermediate transfer roller) were similarly to the intermediate transfer materials 1 and 2, respectively, except that the substrate layer 1 was replaced by substrate layer 3 (elastic layer).

Intermediate Transfer Materials 18

Intermediate transfer materials 18 was prepared similarly to the intermediate transfer material 13, respectively, except that BLEMER LA was replaced by BLENMER SA.

Evaluation

The thus prepared intermediate transfer materials 1-17 were each loaded on an improved C250 printer, manufactured by Konica Minolta Business Technology Inc. to undergo evaluation.

Image formation was performed by using a two-component toner composed of a toner exhibiting a volume median diameter ($D_{50}$) of 4.5 μm and a coat carrier exhibiting a volume median diameter ($D_{50}$) of 60 μm. Printing was conducted under environments of high temperature and high humidity (33° C., 80% RH), and low temperature and low humidity (10° C., 20% RH). A4 size fine-quality paper was used as an output medium.

As an original print was used a picture comprised of a text image of yellow, magenta, cyan and black each exhibiting a printing ratio of 5%; a color half-tone image; a solid white image and a solid image which were equally divided into fourths (¼).

Image evaluation was made with respect to the following items, based on criteria described below, in which "A" and "B" each represented a grade of no problem in practical use, "C" represented as being acceptable in practical use and "D" represented unacceptable problems in practical use.

Transferability

Transferability was evaluated with respect to a solid image obtained by fixing a toner image onto an output medium through an intermediate transfer material. Specifically, printing of 10,000 sheets was performed under high temperature and high humidity (33° C., 80% RH) and the image density of the printed image of the 10,000th sheet was measured by using a densitometer to evaluate transferability, based on the following criteria:

A: a solid image density of 1.40 or more and superior transferability were achieved, and having no problem;

B: the solid image density was not less than 1.25 and less than 1.40, but it was no problem in practice although transferability was slightly lower than the foregoing A;

C: the solid image density was not less than 1.20 and less than 1.25, but it was anyhow acceptable in practice although transferability was lowered;

D: the solid image density was not less than 1.20 and in addition, the transfer rate was poor and overall unacceptable in practice.

Hollow Defect

Texts were enlarged to visually observe occurrence of hollow defects and evaluated based on the following criteria:

A: no marked hollow defect was observed through completion of printing of the 100,000th sheet, B: no marked hollow defect was observed through completion of printing of the 50,000th sheets, C: slight hollow defects occurred on printing less than 50,000 sheets, D: marked hollow defects occurred on printing less than 50,000 sheets.

Flaw in Halftone

Printing of 10,000 sheets was conducted under high temperature and high humidity (33° C., 80% RH). The halftone portion of the 10,000th sheet print was visually observed with respect to flaws due to unevenness in the halftone portion and evaluated based on the following criteria:

A: no flaw was observed,

B: one flaw was observed but represented no problem in practice,

C: two flaws were observed but were acceptable in practice,

D: three or more flaws were observed and the print was not acceptable in practice.

Durability

Printing of 30,000 sheets was conducted under low temperature and low humidity (10° C., 20% RH). The surface of an intermediate transfer material was visually observed every 10,000th sheet for cracking. Adhesiveness Adhesion property of an intermediate transfer material was evaluated in a so-called square test, in which only a surface layer was cut by a cutter knife so as to form 10×10 squares of 1 mm and adhesive tape was sufficiently adhered to cut portions by rubbing with a rounded bar or the like. Then, one end of the tape was strongly peeled at an angle of 45°. Adhesion was evaluated based on the number of squares adhered to the peeled away tape.

A: the number of peeled squares was 0-2 and represented was no problem in adhesion property, B: the number of peeled squares was 3-5 and represented no problem in practice, C: the number of peeled squares was 6-10 and represented an acceptable level in practice, D: the number of peeled squares was 11 or more and represented an unacceptable level in practice.

TABLE 2

| Intermediate Transfer Material No. | Substrate Layer | Surface Layer Resin | Material 1*1 (*2) | Material 2*3 (*4) | Transferability | Hollow Defect | Flaw | Durability | Adhesiveness |
|---|---|---|---|---|---|---|---|---|---|
| 1(Inv.) | polyimide | acryl | PET30(3) | — | B | C | A | B | B |
| 2(Inv.) | polyimide | acryl | DPHA(6) | PEG400DA (2) | A | A | B | B | B |
| 3(Inv.) | polyimide | acryl | DPHA(6) | BLENMER LA (1) | A | A | A | A | B |
| 4(Inv.) | polyimide | acryl | DPHA(6) | MANDA(2) | A | A | A | B | B |
| 5(Inv.) | polyimide | acryl | D-310(5) | — | A | B | A | B | B |
| 6(Inv.) | polyimide | acryl | DPHA(6) | UX8101(2) | A | A | A | A | B |
| 7(Inv.) | Nickel | acryl | PET30(3) | — | C | C | B | C | B |
| 8(Comp.) | polyimide | — | — | — | D | D | D | B | *5 |
| 9(Comp.) | polyimide | silicone | KP854(4) | — | B | B | D | D | D |
| 10(Comp.) | polyimide | acryl | PMMA(1) | — | D | D | D | D | C |
| 11(Inv.) | PPS | acryl | PET30(3) | — | A | C | A | B | A |
| 12(Inv.) | PPS | acryl | DPHA(6) | PEG400DA (2) | A | A | B | B | A |
| 13(Inv.) | PPS | acryl | DPHA(6) | BLENMER LA (1) | A | A | A | A | A |
| 14(Inv.) | PPS | acryl | DPHA(6) | MANDA(2) | A | A | A | B | A |
| 15(Inv.) | PPS | acryl | PEG400G(2) | — | C | C | C | C | B |
| 16(Inv.) | elastic layer | acryl | PET30(3) | — | C | C | A | B | C |
| 17(Inv.) | elastic layer | acryl | DPHA(6) | PEG400DA (2) | C | C | B | B | C |
| 18(Inv.) | PPS | acryl | DPHA(6) | BLENMER SA (1) | A | A | A | A | A |

*1Resin raw material 1,
(*2) Number of functional groups,
*3Resin raw material 2
*(4) Number of functional groups,
*5: No evaluation was made As shown in Table 2, intermediate transfer materials which were each provided with a surface layer of cured acrylic resin resulted in superior transferability and improved durability. On the contrary, an intermediate transfer material which was not provided with a surface layer resulted in inferior transferability, hollow defects and poor durability. An intermediate transfer material which was provided with a surface layer of a silicone resin was inferior in adhesiveness and flaw resistance and insufficient in durability, compared to cured acrylic resin.

What is claimed is:

1. An intermediate transfer material, for use in an image forming apparatus in which a toner image on an electrostatic latent image carrier is transferred onto the intermediate transfer material and the toner image on the intermediate transfer material is further transferred onto a final transfer material, wherein the intermediate transfer material comprises a substrate layer having thereon a surface layer, and the surface layer comprising a light-cured (meth)acrylic resin.

2. The intermediate transfer material of claim 1, wherein the substrate layer comprises a resin capable of dissolving or swelling in a coating solvent of the surface layer and a resistance-controlling agent.

3. The intermediate transfer material of claim 1, wherein the substrate layer comprises a resin capable of dissolving or swelling in a mixture of methyl isobutyl ketone and methyl ethyl ketone in a weight ratio of 8:2.

4. The intermediate transfer material of claim 1, wherein the substrate layer comprises at least one resin selected from the group consisting of a poly(phenylene sulfide), a polyimide, a poly(amidoimide) and a polycarbonate.

5. The intermediate transfer material of claim 4, wherein the resin is a poly(phenylene sulfide).

6. The intermediate transfer material of claim 4, wherein the resin is a polyimide.

7. The intermediate transfer material of claim 1, wherein the intermediate transfer material is an intermediate transfer belt which comprises a resin substrate in a belt form and having thereon the surface layer.

8. The intermediate transfer material of claim 1, wherein the cured (meth)acrylic resin is a resin formed by reacting one or more (meth)acrylic monomers and at least one (meth) acrylic monomer is a polyfunctional (meth) acrylic monomer containing at least two (meth)acryloyl groups in the molecule.

9. The intermediate transfer material of claim 8, wherein the polyfunctional (meth)acrylic monomer contains at least five (meth)acryloyl groups in the molecule.

10. The intermediate transfer material of claim 8, wherein the polyfunctional (meth)acrylic monomer containing at least two (meth)acryloyl groups accounts for 40 to 90% by weight of total (meth)acrylic monomers.

11. The intermediate transfer material of claim 1, wherein the cured (meth)acrylic resin is a resin formed by reacting a (meth)acrylic monomer containing an alkyl group having at least 12 carbon atoms.

12. The intermediate transfer material of claim 1, wherein the cured (meth)acrylic resin is a resin formed by reacting a (meth)acrylic oligomer containing two (meth) acryloyl groups.

13. An image forming method comprising:

developing an electrostatic latent image on an electrostatic latent image carrier by a tone to form a toner image, transfer the toner image on the carrier onto an intermediate transfer material, and transfer the toner image on the intermediate transfer material onto a final transfer material, wherein the intermediate transfer material comprises a substrate layer having thereon a surface layer, and the surface layer comprising a light-cured (meth)acrylic resin.

14. The image forming method of claim 13, wherein the substrate layer comprises at least one resin selected from the group consisting of a poly(phenylene sulfide), a polyimide, a poly(amidoimide) and a polycarbonate.

15. The image forming method of claim 14, wherein the resin is a poly(phenylene sulfide).

16. The image forming method of claim 14, wherein the resin is a polyimide.

17. The image forming method of claim 13, wherein the intermediate transfer material is an intermediate transfer belt which comprises a resin substrate in a belt form and having thereon the surface layer.

18. The image forming method of claim 13, wherein the cured (meth)acrylic resin is a resin formed by reacting one or more (meth)acrylic monomers and at least one (meth)acrylic monomer is a polyfunctional (meth)acrylic monomer containing at least two (meth)acryloyl groups in the molecule.

19. The image forming method of claim 18, wherein the polyfunctional (meth)acrylic monomer contains at least five (meth)acryloyl groups in the molecule.

20. The image forming method of claim 18, wherein the polyfunctional (meth)acrylic monomer containing at least two (meth)acryloyl groups accounts for 40 to 90% by weight of total (meth)acrylic monomers.

21. The image forming method of claim 13, wherein the cured (meth)acrylic resin is a resin formed by reacting a (meth)acrylic monomer containing an alkyl group having at least 12 carbon atoms.

22. The image forming method of claim 13, wherein the cured (meth)acrylic resin is a resin formed by reacting a (meth)acrylic oligomer containing two (meth) acryloyl groups.

23. An image forming apparatus, used for an image forming method as claimed in claim 13.

* * * * *